US008548355B2

(12) United States Patent
Tomatsu

(10) Patent No.: US 8,548,355 B2
(45) Date of Patent: Oct. 1, 2013

(54) SUPPORT MEMBER FOR ROTARY MEMBER

(75) Inventor: Yoshiya Tomatsu, Kasugai (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 981 days.

(21) Appl. No.: 12/240,446

(22) Filed: Sep. 29, 2008

(65) Prior Publication Data

US 2009/0092414 A1 Apr. 9, 2009

(30) Foreign Application Priority Data

Oct. 5, 2007 (JP) ..... 2007-262387

(51) Int. Cl.
*G03G 15/00* (2006.01)

(52) U.S. Cl.
USPC ..... 399/117

(58) Field of Classification Search
USPC ..... 399/117
See application file for complete search history.

(56) References Cited

U.S. PATENT DOCUMENTS

| | | | | |
|---|---|---|---|---|
| 4,846,595 | A | 7/1989 | Kato et al. | |
| 6,198,891 | B1 | 3/2001 | Ishida et al. | |
| 6,483,527 | B2 | 11/2002 | Kaneko et al. | |
| 2007/0036582 | A1 | 2/2007 | Okabe | |
| 2007/0110473 | A1 * | 5/2007 | Kondo et al. | 399/117 |
| 2007/0183814 | A1 * | 8/2007 | Kamimura | 399/228 |

FOREIGN PATENT DOCUMENTS

| | | | |
|---|---|---|---|
| JP | 62-279977 | | 12/1987 |
| JP | 10-291654 | | 11/1998 |
| JP | HEI 11-344849 | | 12/1999 |
| JP | 2000298386 | A * | 10/2000 |
| JP | 2002-108050 | | 4/2002 |
| JP | 2002-148967 | | 5/2002 |
| JP | 2002-189324 | | 7/2002 |
| JP | 2004-29419 | | 1/2004 |
| JP | 2005-181432 | | 7/2005 |
| JP | 2007-72422 | | 3/2007 |

OTHER PUBLICATIONS

Japanese Official Action dated Oct. 18, 2011 from related application JP 2007-262387.

Japanese Decision of Patent Grant dated Feb. 14, 2012 together with a partial English language translation from JP 2007-262387.

* cited by examiner

*Primary Examiner* — David Gray
*Assistant Examiner* — Erika J Villaluna
(74) *Attorney, Agent, or Firm* — Scully, Scott, Murphy & Presser, P.C.

(57) ABSTRACT

A method is for manufacturing a support member for supporting a rotary member having a shaft. The support member is detachably assembled in an image-forming device. The support member has a pair of side plates opposed to each other through the rotary member. Each of the side plate receives the shaft of the rotary member. The method includes forming the pair of side plates through a punching process using the same die.

6 Claims, 9 Drawing Sheets

SUPPORT MEMBER FOR ROTARY MEMBER

CROSS REFERENCE TO RELATED APPLICATIONS

This application claims priority from Japanese Patent Application No. 2007-262387 filed Oct. 5, 2007. The entire content of the priority application is incorporated herein by reference.

TECHNICAL FIELD

The present invention relates to a support member for supporting rotary member and a method of manufacturing the support member.

BACKGROUND

Japanese unexamined patent application publication No. 2007-72422 discloses a tandem-type image-forming device having a photosensitive member unit that can be integrally and detachably assembled in the casing of the image-forming device, the photosensitive member unit including a plurality of photosensitive members, and a pair of side plates disposed on both ends of the photosensitive members for receiving shafts of the photosensitive members.

However, in the image-forming device described above, the rotating shafts of the photosensitive members may slope in a direction orthogonal to a paper-conveying direction, leading to a reduction in image quality due to distortion in the formed images and the like. Accordingly, shaft-receiving parts provided in the side plates for receiving the shafts of the photosensitive members must be formed with great precision. However, the side plates in this conventional image-forming device are configured of separate members that are symmetrical to each other and, thus, are molded from different dies. Consequently, manufacturing error can easily be introduced into the side plates, causing the rotating shafts of the photosensitive members supported by the side plates to deviate in a direction orthogonal to the paper-conveying direction. The same problem of deviation may occur with parts provided for receiving the shafts of the photosensitive members used in image formation if these parts are detachably assembled in the casing of the image-forming device.

SUMMARY

In view of the foregoing, it is an object of the present invention to provide a support member capable of suppressing tilt in the shaft of a rotary member which is detachably assembled in the casing of the image-forming device.

The present invention provides a method for manufacturing a support member for supporting a rotary member having a shaft, the support member being movably provided in an image-forming device, the support member having a pair of side plates opposed to each other through the rotary member, each of the side plate receiving the shaft of the rotary member. The method including forming the pair of side plates through a punching process using the same die.

The present invention provides a support member that is movably provided in a main casing of an image-forming device for supporting a rotary member having a shaft. The support member includes a pair of side plates opposed to each other through the rotary member. The pair of side plate receives the shaft thereof. The pair of side plates having the same outer shape.

The present invention provides an image-forming device having a main casing; and a support member movably provided in the main casing. The support member supports a rotary member having a shaft. The support member has a pair of side plates opposed to each other through the rotary member for receiving the shaft thereof. The pair of side plates has the same outer shape.

The present invention provides a photo sensitive drum support member for supporting a plurality of photosensitive drums for an image-forming device, each of the plurality of photosensitive drums having a shaft. The photo sensitive drum support member has a pair of side plates opposed to each other through the plurality of photosensitive drums. The pair of side plates receives the shafts thereof. The pair of side plates has the same outer shape.

BRIEF DESCRIPTION OF THE DRAWINGS

The particular features and advantages of the invention as well as other objects will become apparent from the following description taken in connection with the accompanying drawings, in which.

DETAILED DESCRIPTION

An embodiment of the present invention will be described while referring to FIGS. 1-9. The expressions "front", "rear", "above" and "below" are used throughout the description to define the various parts when an image-forming device is disposed in an orientation in which it is intended to be used.

Figure 1:
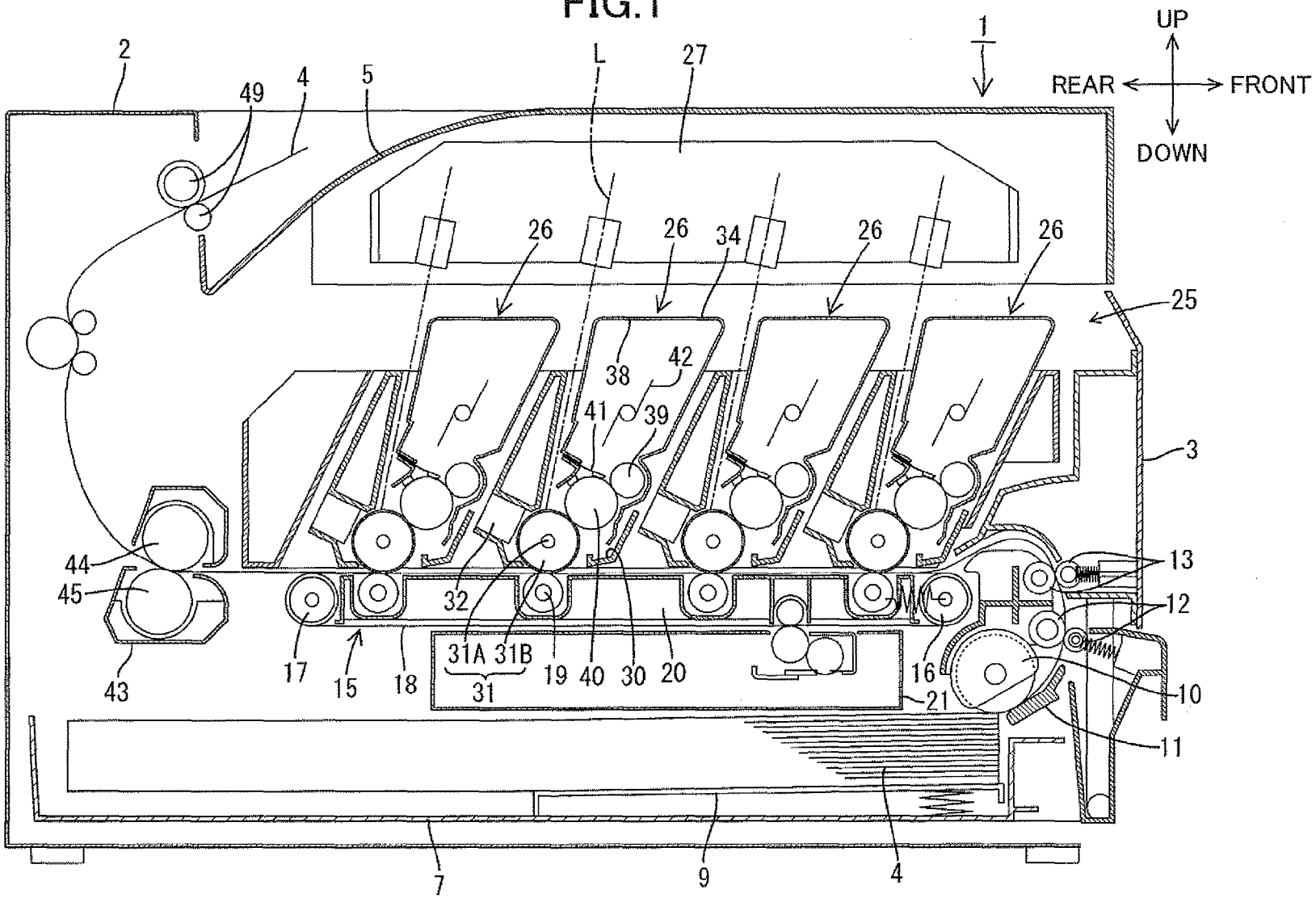
FIG. 1 is a schematic diagram showing a printer according to an embodiment of the present invention.

FIG. 1 shows a direct transfer tandem-type color laser printer. The printer 1 has a main casing 2 which is formed substantially in a box shape. The printer 1 includes a process unit 25, a scanner unit 27, a paper cassette 7, a belt unit 15, and a fixing unit 43 in the main casing 2.

Overall the main casing 2 is shaped in the form of a rectangular parallelepiped that is open on front and rear ends. A front cover 3 is disposed for opening and closing the front surface of the main casing 2. A discharge tray 5 is formed on the top surface of the main casing 2 for accommodating a paper 4 after the paper has undergone an image-forming operation.

Figure 2:
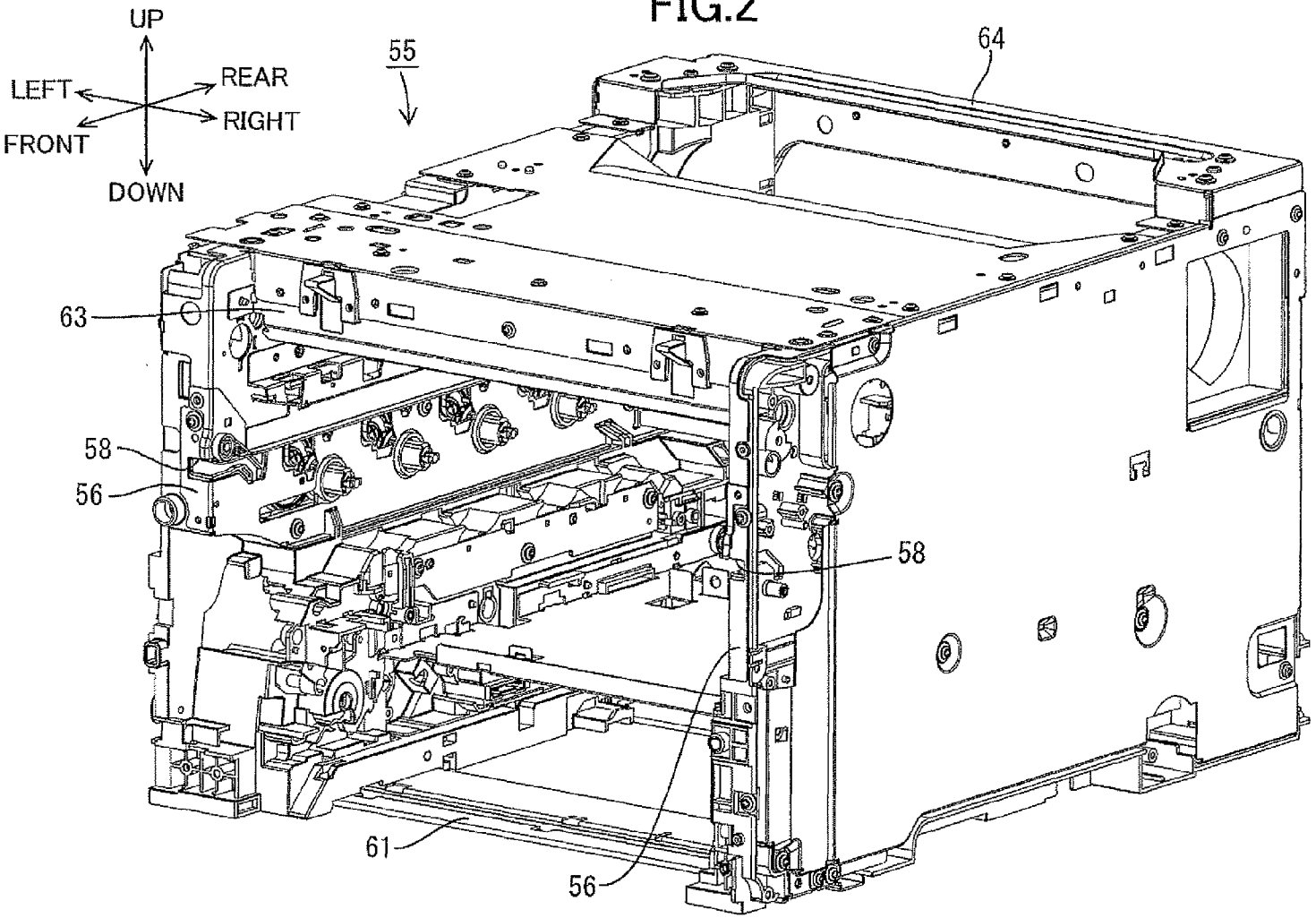
FIG. 2 is a perspective view showing a main casing of the printer when viewed from the front side of the printer.
Figure 3:
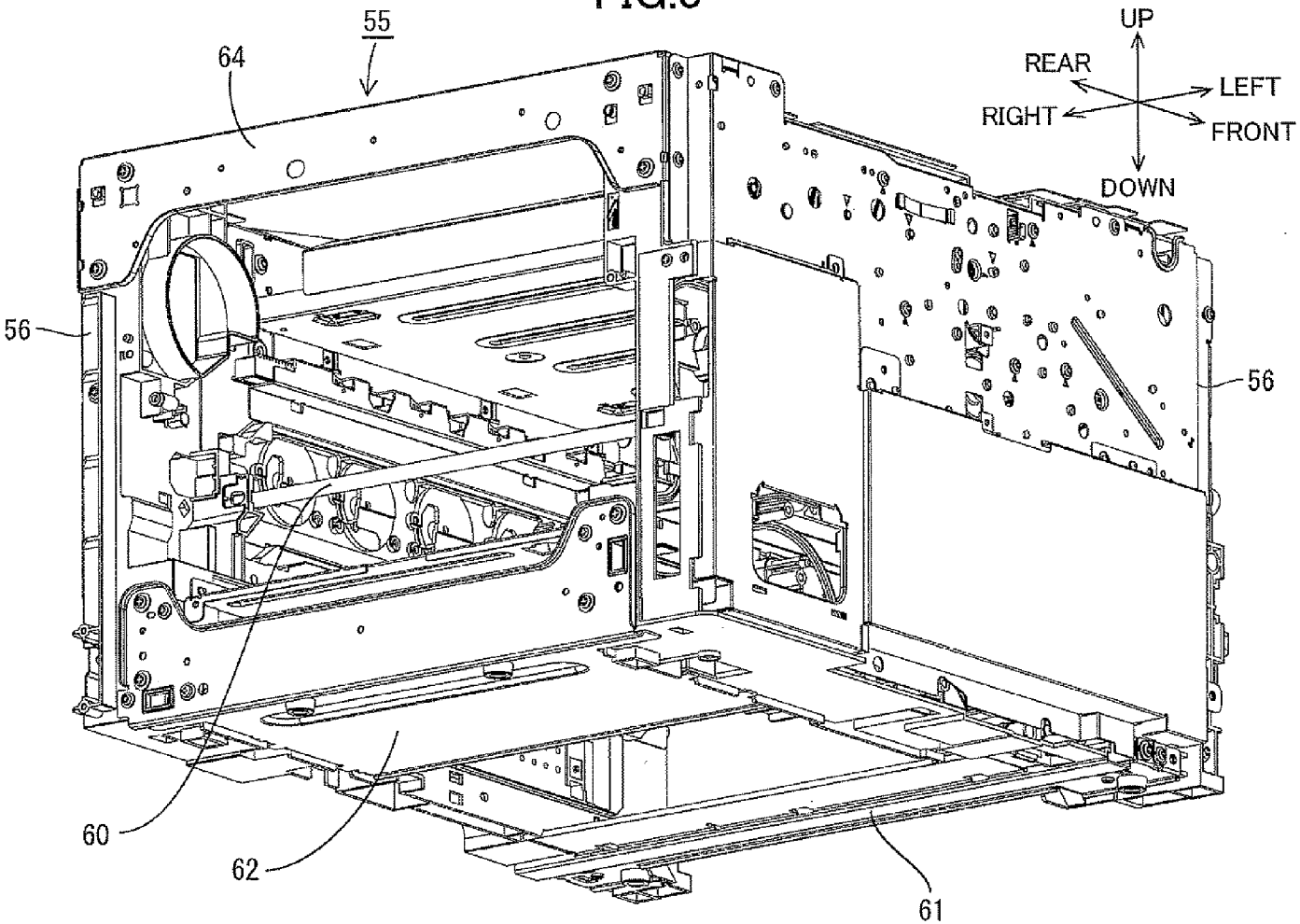
FIG. 3 is a perspective view showing the main casing when viewed from the rear side.

As shown in FIGS. 2 and 3, the main casing 2 is configured of a main frame 55 forming the framework of the main casing 2, and an outer cover (not shown). The outer cover is formed of a synthetic resin and covers the outer surface of the main frame 55. The main frame 55 further includes side walls 56 facing each other, a metal bottom beam 61 and a metal bottom plate 62 fixed to the bottom edges of the side walls 56 by screws for linking the bottom edges of the side walls 56, and a metal front beam 63 and a metal rear beam 64 fixed to the top edges of the side walls 56 by screws for linking the top edges of the side walls 56.

As shown in FIG. 1, the paper cassette 7 is disposed in a bottom section of the main casing 2 for accommodating the paper 4 used in image formation. The paper cassette 7 can be removed from the main casing 2 through the front side of the printer 1. A paper-pressing plate 9 disposed in the bottom of the paper cassette 7 pushes the paper 4 accommodated in the paper cassette 7 upward so that the topmost sheet of the paper 4 is pressed against a pickup roller 10. As the pickup roller 10 rotates, a sheet of the paper 4 become interposed between the pickup roller 10 and a separating pad 11 so that the paper 4 is separated and fed one sheet at a time. Conveying rollers 12 are disposed downstream of the pickup roller 10 for conveying each sheet of the paper 4 passing between the pickup roller 10 and separating pad 11 to registration rollers 13 positioned further downstream. The registration rollers 13 subsequently convey the sheet of paper 4 at a prescribed timing to the belt unit 15 disposed to the rear of the registration rollers 13.

The belt unit 15 is detachably mounted in the main casing 2 and includes a belt frame 20 constructed of rectangular plates formed of synthetic resin. The belt frame 20 is disposed horizontally in the main casing 2. Support rollers 16 and 17 are rotatably provided one in the front and one in the rear of the belt frame 20. An endless conveying belt 18 is stretched around the support rollers 16 and 17. When the support roller 17 disposed in the rear side of the belt frame 20 is driven to rotate, the belt 18 moves circularly in the counterclockwise direction of FIG. 1, thereby conveying a sheet of the paper 4 resting on the top surface of the belt 18 rearward.

Four transfer rollers 19 are arranged between the support rollers 16 and 17 at substantially regular intervals in the front-to-rear direction and rotatably supported in the belt frame 20. The belt 18 is pinched between the transfer rollers 19 and corresponding photosensitive drums 31 provided in respective image-forming units 26 described later. During a transfer operation, a transfer bias is applied between the transfer rollers 19 and photosensitive drums 31. A cleaning unit 21 is provided below the belt unit 15 for removing toner, paper dust, and the like deposited on the belt 18.

The process unit 25 is disposed above the belt unit 15, and the scanner unit 27 is disposed above the process unit 25. The scanner unit 27 functions to irradiate laser beams L emitted from laser light-emitting units (not shown) for four different colors onto the surfaces of the corresponding photosensitive drums 31.

The process unit 25 includes four of the image-forming units 26 corresponding to the four colors magenta, yellow, cyan, and black. The image-forming units 26 are detachably mounted in a drum-supporting member 70 provided in the main casing (see FIG. 4) so as to be juxtaposed in the front-to-rear direction. By opening the front cover 3 described above, an operator can pull the drum-supporting member 70 out of the main casing 2 through the front surface thereof. Each of the image-forming units 26 includes the photosensitive drum 31, a Scorotron charger 32, and a developer cartridge 34.

The photosensitive drum 31 includes a grounded rotatable drum shaft 31A formed of metal, and a cylindrical main drum member 31B provided integrally with the drum shaft 31A. The drum shaft 31A is driven to be rotated so that the photosensitive drum 31 is rotatable about the drum shaft 31A. The outermost layer of the main drum body 31B is configured of a positively chargeable photosensitive layer. The charger 32 is disposed diagonally above and rearward of the photosensitive drum 31 and opposes the photosensitive drum 31 at a prescribed distance so as not to contact the same.

The developer cartridge 34 has a substantially box-like shape. A toner-accommodating chamber 38 is provided in the upper section of the developer cartridge 34, while a supply roller 39, a developing roller 40, and a thickness-regulating blade 41 are disposed in the bottom section. Each of the toner-accommodating chambers 38 accommodates a positively chargeable, nonmagnetic, single-component toner in one of the colors yellow, magenta, cyan, and black as a developer. An agitator 42 is also provided in each toner-accommodating chamber 38 for stirring the toner.

The supply roller 39 rotates to supply toner discharged from the toner-accommodating chamber 38 to the developing roller 40, so that the toner is positively tribocharged between the supply roller 39 and developing roller 40. The toner supplied onto the developing roller 40 is introduced between the developing roller 40 and thickness-regulating blade 41 as the developing roller 40 rotates. The toner is further tribocharged and is carried on the developing roller 40 as a uniform thin layer of toner.

After the charger 32 has charged the surface of the photosensitive drum 31 with a uniform positive polarity, the scanner unit 27 irradiates a laser beam L in a high-speed scan over the surface of the photosensitive drum 31, forming an electrostatic latent image corresponding to an image to be formed on the paper 4. Subsequently, the developing roller 40 supplies positively charged toner to the surface of the photosensitive drum 31 for developing the electrostatic latent image into a visible toner image of the corresponding color.

Next, as the belt 18 conveys a sheet of paper 4 through each transfer position between the photosensitive drums 31 and transfer rollers 19, the toner images carried on the surfaces of the photosensitive drums 31 are sequentially transferred onto the paper 4 by a negative transfer bias applied to the transfer rollers 19.

After the toner images have been transferred onto the paper 4, the paper 4 is conveyed to the fixing unit 43. The fixing unit 43 includes a heating roller 44 and a pressure roller 45 for fixing the toner images to the paper 4 by heat as the paper 4 passes through the fixing unit 43. The paper 4 is subsequently conveyed to discharge rollers 49 provided in the top of the main casing 2, and the discharge rollers 49 discharge the paper onto the discharge tray 5.

Figure 4:
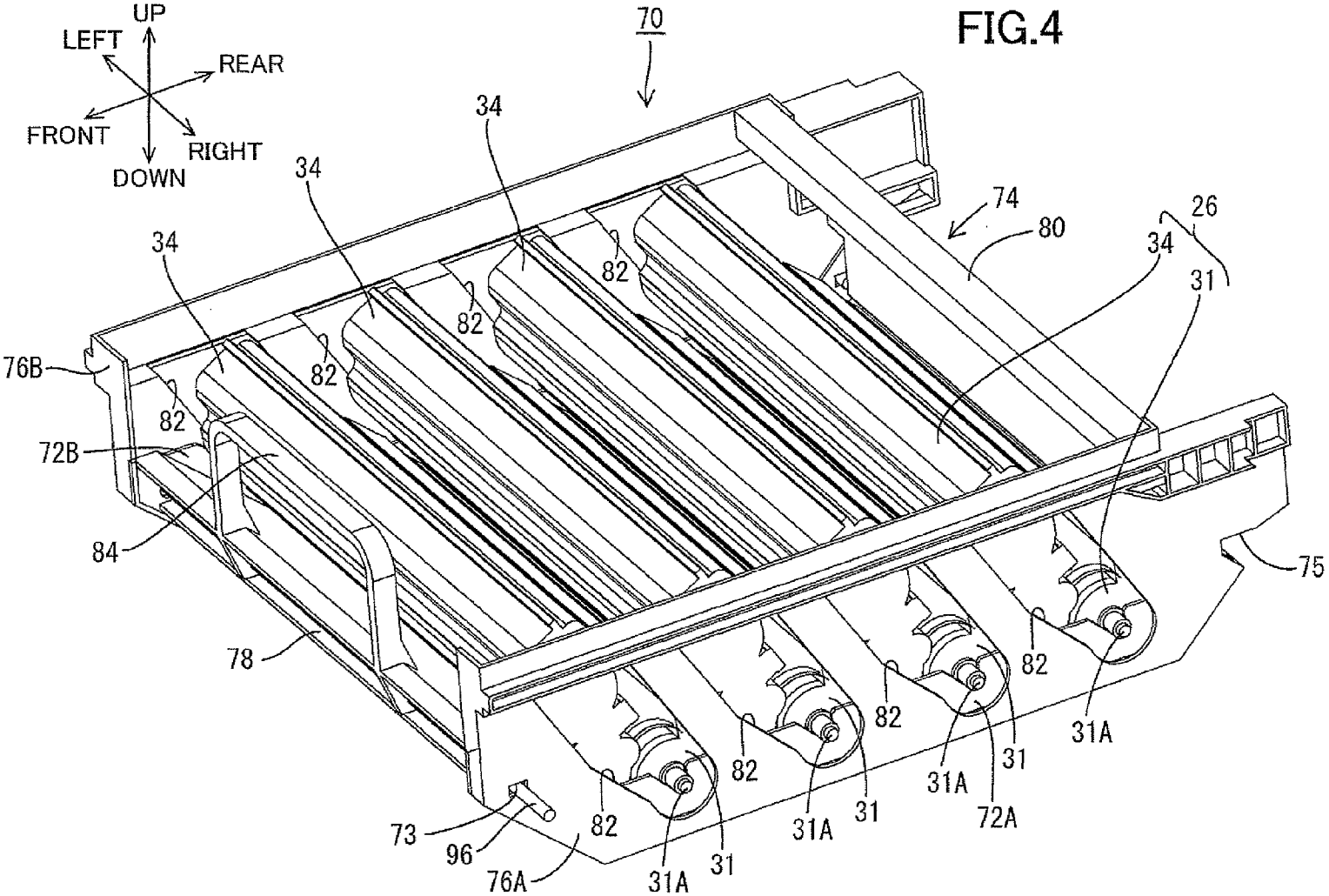
FIG. 4 is a perspective view of the drum-supporting member with an image-forming unit being assembled therein.
Figure 5:
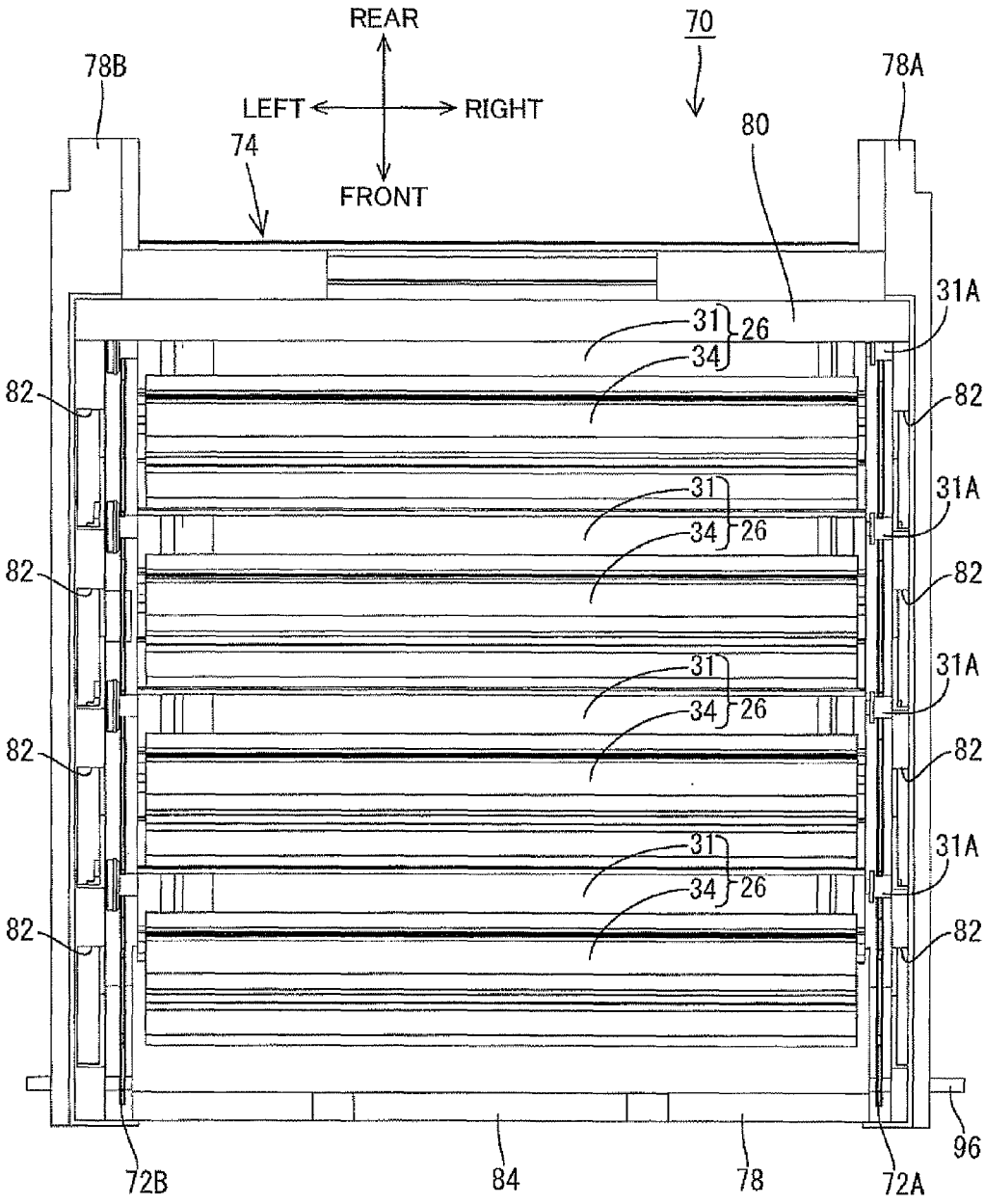
FIG. 5 is a top view of the drum-supporting member shown in FIG. 4.
Figure 6:
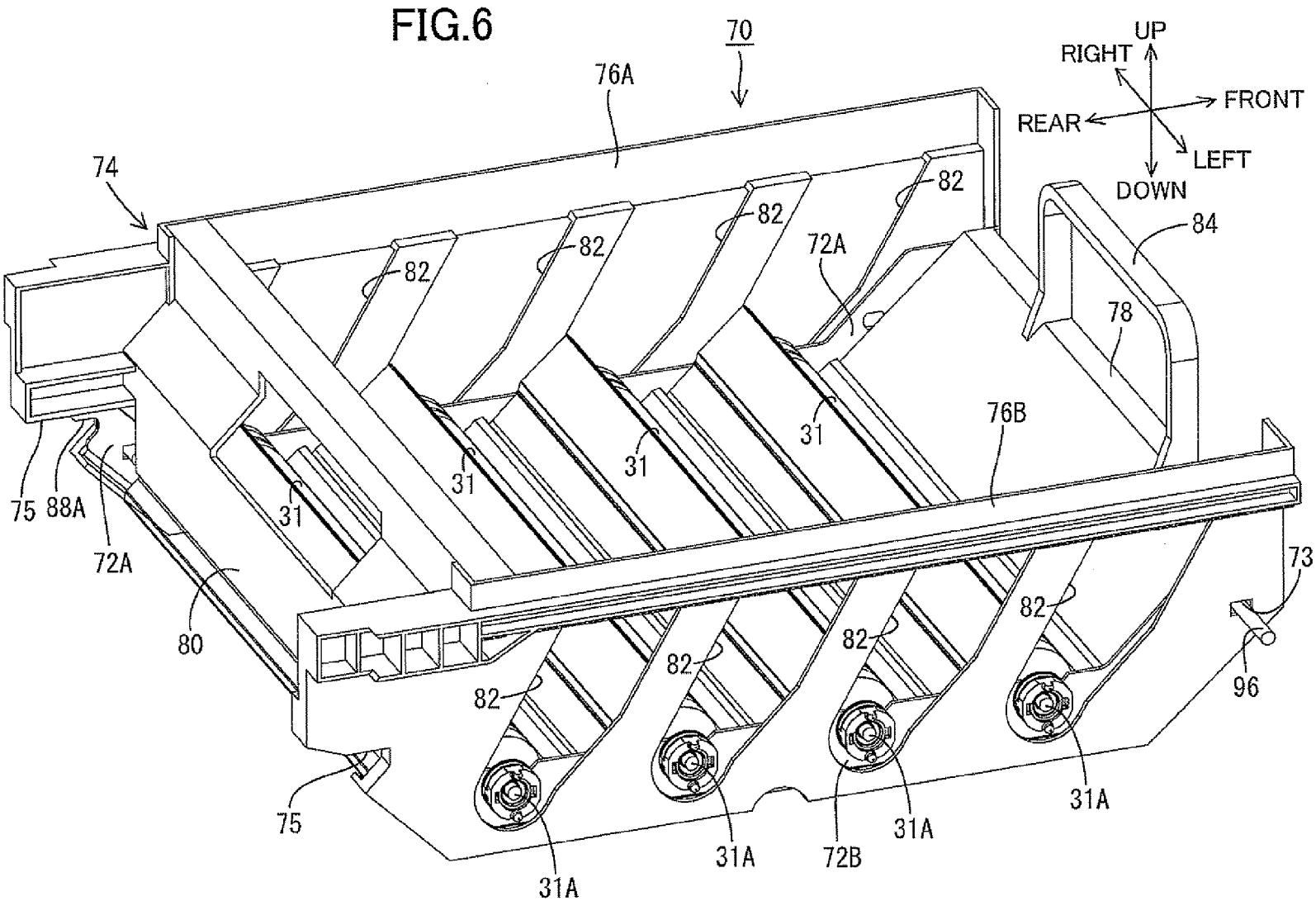
FIG. 6 is a perspective view of the drum-supporting member without developer cartridges.

Next, the structure of the drum-supporting member 70 will be described. Referring to FIG. 4, the drum-supporting member 70 includes a pair of shaft-receiving members 72A and 72B for receiving the drum shafts 31A of the photosensitive drums 31, and an accommodating member 74 for accommodating the pair of shaft-receiving members 72A and 72B.

The accommodating member 74 is a frame-like member formed of synthetic resin and includes a pair of side walls 76A and 76B, a front wall 78 linking the front edges of the side walls 76A and 76B, and a rear wall 80 linking the rear edges of the side walls 76A and 76B.

Each of the side walls 76A and 76B has four U-shaped grooves 82 formed at intervals in the front-to-rear direction. Each groove 82 has an open upper end and a bottom end. By engaging left and right edges of each developer cartridge 34 in corresponding U-shaped grooves 82 formed in the side walls 76A and 76B and inserting the developer cartridges 34 into the accommodating member 74 along these U-shaped grooves 82, the developer cartridges 34 are held in position within the accommodating member 74. At the same time, the photosensitive drum 31 positioned on the bottom of each developer cartridge 34 is received within the pair of shaft-receiving members 72A and 72B. Since the side walls 76A and 76B formed of synthetic resin are substantially shaped with left-right symmetry, different molds must be used to form the side walls 76A and 76B.

Figure 7:
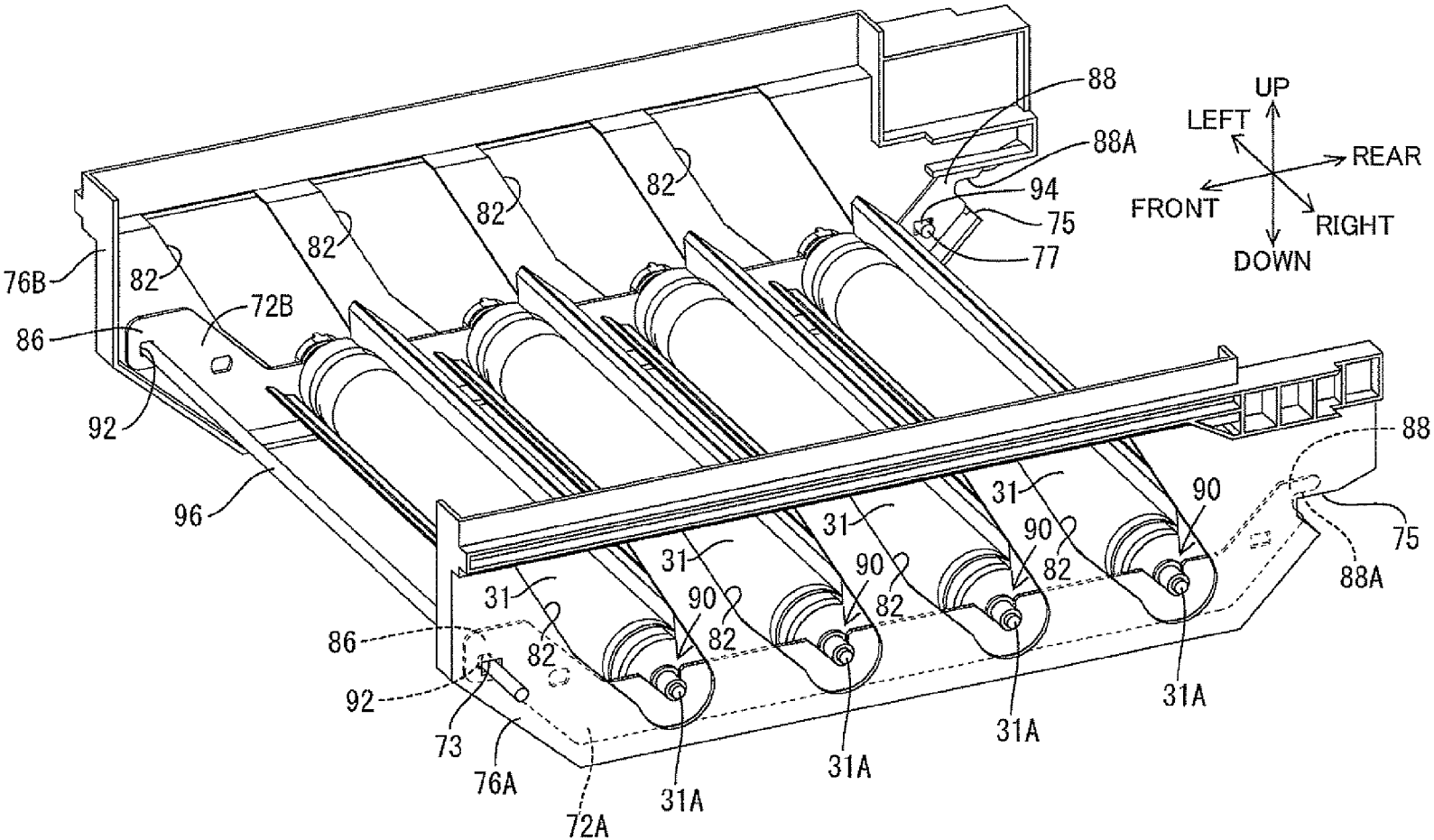
FIG. 7 is a perspective view of the drum-supporting member without a front wall and rear wall of an accommodating member.
Figure 8:
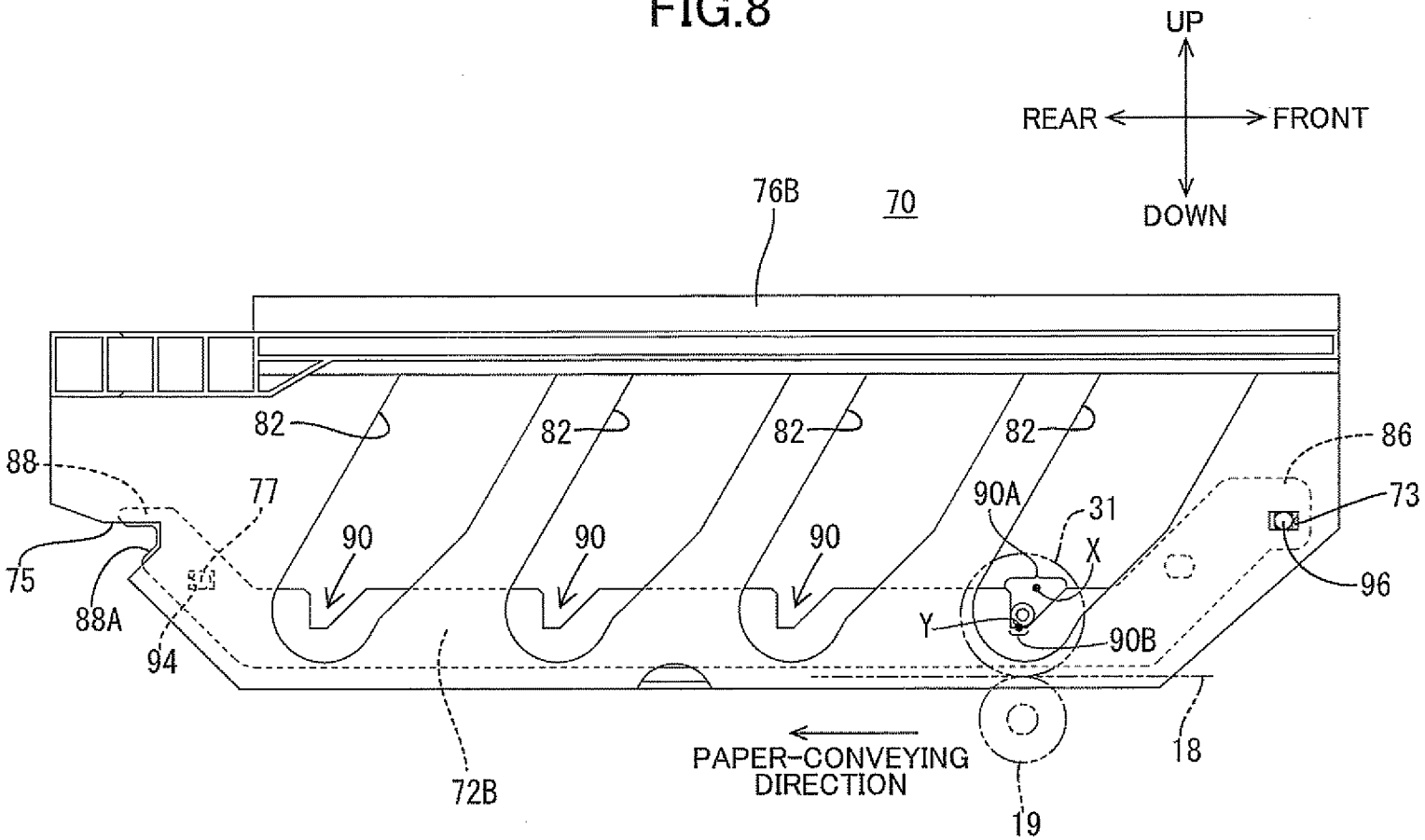
FIG. 8 is a left side view of the drum-supporting member.

As shown in FIGS. 7 and 8, a horizontally elongated insertion hole 73 is formed near the front end of each of the side walls 76A and 76B, while a notched part 75 is formed in the rear end thereof. A protrusion 77 is also formed on the inner surface of each of the side walls 76A and 76B near the respective notched part 75. Further, as shown in FIG. 4, a handle 84 is provided on the front wall 78 of the accommodating member 74 since the front wall 78 is positioned to the rear of the front cover 3 inside the main casing 2.

Figure 9:
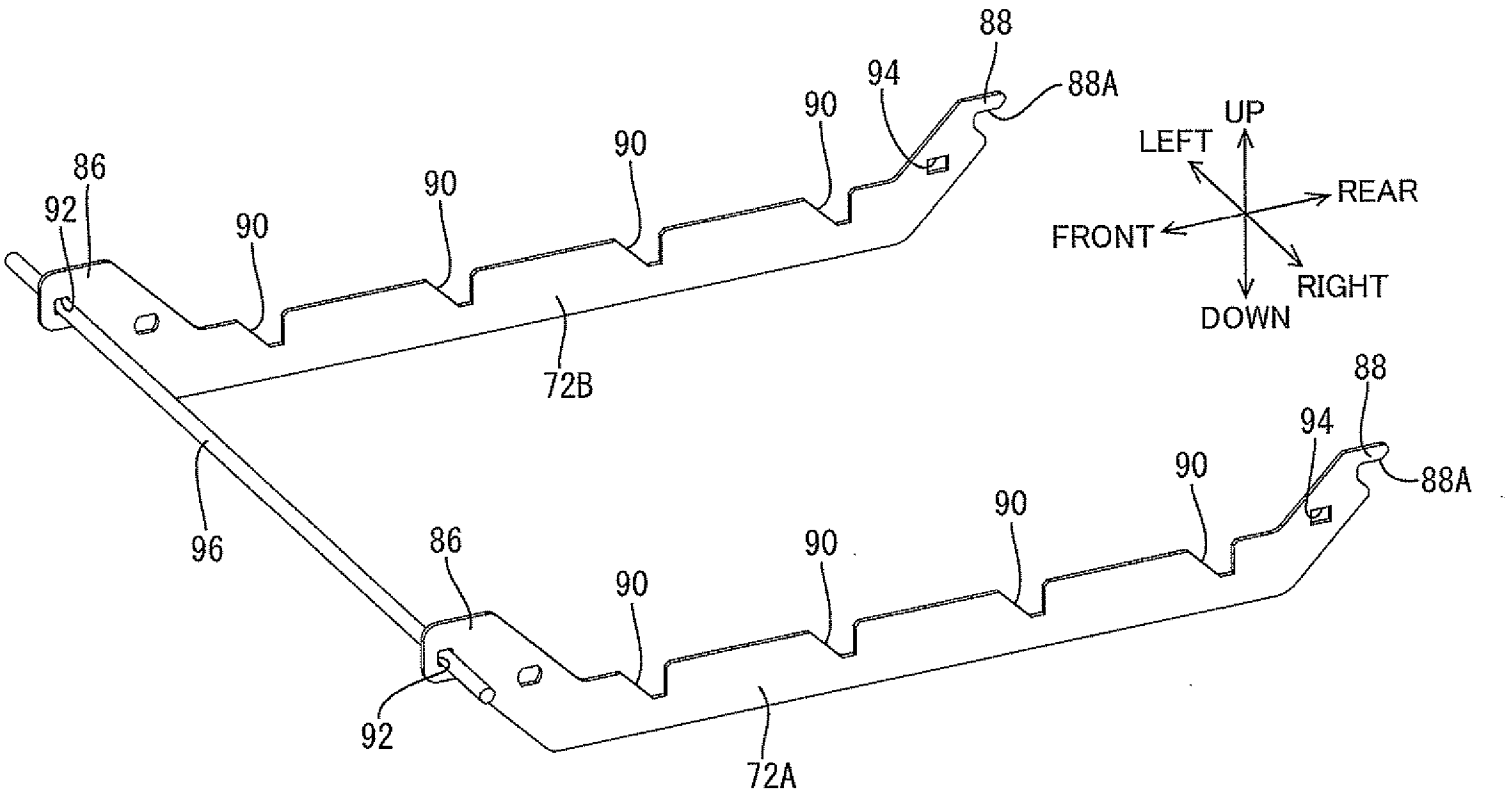
FIG. 9 is a perspective view of a pair of shaft-receiving members.

As shown in FIG. 7, the right shaft-receiving member 72A is accommodated inside the right side wall 76A, and the left shaft-receiving member 72B is accommodated inside the left side wall 76B. As shown in FIG. 9, the shaft-receiving members 72A and 72B have the same outer shape. The shaft-receiving members 72A and 72B are formed in the same shape through a process of punching sheet metal with the same die.

Since the punching process involves simply shearing the sheet metal, without bending or the like, both the shaft-receiving members 72A and 728 are entirely planar in shape. Here, this condition for both shaft-receiving members 72A and 72B to have the same shape is satisfied if the outline and the major portions of both members are identical to each other, and even if a hole is formed in only one of the shaft-receiving members 72A, for example. In other words, the shaft-receiving member 72A has a first portion related to positioning the shaft-receiving member 72A itself to the side wall 76A, and a second portion related to receiving the drum shaft 31A of the photosensitive drum 31; and the shaft-receiving member 72B has a first portion related to positioning the shaft-receiving member 72B itself to the side wall 76B, and a second portion related to receiving the drum shaft 31A of the photosensitive drum 31. Further, if the first portion of the shaft-receiving member 72A is identical to the first portion of the shaft-receiving member 72B, and the second portion of the shaft-receiving member 72A is identical to the second portion of the shaft-receiving member 72B in terms of shape, the shaft-receiving members 72A and 72B are considered identical to each other. In this embodiment, if the shaft-receiving groove 90, the positioning holes 92, 94, and the positioning recess 88A are identical between the shaft-receiving members 72A, 72B, the shaft-receiving members 72A, 72B may be different from each other in terms of any potions other than the above portions.

In brief, at least the second portion related to receiving the drum shaft 31A of the photosensitive drum 31 is formed through a punching process by using the same die for each of the shaft-supporting members 72A, 72B. Accordingly, when the shaft-supporting members 72A, 72B are assembled to the side walls 76A, 76B and receives the drum shaft 31A of the photosensitive drum 31, the drum shaft 31A is properly positioned with respect to the drum-supporting member 70.

Overall, the shaft-receiving members 72A and 72B each has a rectangular parallelepiped shape, with a front end 86 and a rear end 88 being oriented upward. Four shaft-receiving grooves 90 are formed in each of the shaft-receiving members 72A and 72B at prescribed intervals. The shaft-receiving members 72A and 72B receive the ends of drum shafts 31A of the photosensitive drums 31 in the shaft-receiving grooves 90. As shown in FIG. 8, each of the shaft-receiving grooves 90 has an open part 90A on the top and a closed part 90B on the bottom and is formed in a V-shape that grows narrower from the open part 90A toward the closed part 90B.

Further, each shaft-receiving groove 90 is formed such that a center position Y of the closed part 90B is offset from a center position X of the open part 90A in the paper-conveying direction. The side surface of the shaft-receiving groove 90 on the downstream side in the conveying direction forms an angle of substantially 90 degrees with the conveying direction. The closed part 90B is designed to have a slightly smaller width than the diameter of the drum shaft 31A in the photosensitive drum 31 so that there is no play when the drum shaft 31A is inserted therein.

The photosensitive drum 31, transfer rollers 19, and belt 18 are depicted in FIG. 8 by broken lines with alternating dashes and double dots. When the drum-supporting member 70 is mounted in the main casing 2, the bottom surfaces of the photosensitive drums 31 contact the top portion of the belt 18 or a sheet of paper 4 positioned on the top portion of the belt 18. When the support roller 17 is driven to rotate, the upper portion of the belt 18 moves in the conveying direction. Accordingly, the photosensitive drums 31 receive a force in the conveying direction from the movement of the belt 18. By forming the shaft-receiving grooves 90 as described above, it is possible to rotate the drum shafts 31A of the photosensitive drums 31 in the closed parts 90B of the shaft-receiving grooves 90 during a printing process while restraining deviation of the drum shafts 31A as the photosensitive drums 31 rotate.

Positioning holes 92 are also formed through the front ends 86 of the shaft-receiving members 72A and 72B, while horizontally elongated positioning holes 94 are formed through the rear ends 88. The positioning holes 92 and positioning holes 94 are punched in the shaft-receiving members 72A and 72B using the same die. A metal coupling member 96 is inserted through and fixed in the positioning holes 92, thereby linking the shaft-receiving members 72A and 72B for suppressing positional deviation between the same. In addition, a positioning recess 88A is formed in each of the rear ends 88 of the shaft-receiving members 72A and 72B.

The shaft-receiving members 72A and 72B are accommodated in the side walls 76A and 76B by inserting the protruding ends of the coupling member 96 through the insertion holes 73 in the side walls 76A and 76B and by inserting the protrusions 77 formed on the side walls 76A and 76B into the positioning holes 94 formed in the shaft-receiving members 72A and 72B. Here, the insertion holes 73 are designed with clearance relative to the protruding ends of the coupling member 96, and the positioning holes 94 are designed with clearance relative to the protrusions 77. Hence, the side walls 76A and 76B can separately move in any one of the front-to-rear and vertical directions relative to the shaft-receiving members 72A and 72B. As shown in FIG. 8, the shaft-receiving members 72A and 72B are designed so that the positioning recesses 88A are always exposed in the notched parts 75 of the side walls 76A and 76B.

Next, the structure for mounting the drum-supporting member 70 in the main casing 2 will be described. As shown in FIG. 2, insertion grooves 58 are formed on the front inner surfaces of the side walls 56 constituting the main frame 55. Protruding ends of the coupling member 96 provided on the drum-supporting member 70 are inserted into the insertion grooves 58. As shown in FIG. 3, a positioning member 60 supported in a level state by the side walls 56 is provided on the rear side of the main frame 55. By engaging the positioning member 60 in the positioning recesses 88A of the shaft-receiving members 72A and 72B and by engaging the protruding ends of the coupling member 96 in the insertion grooves 58 of the side walls 56, the shaft-receiving members 72A and 72B of the drum-supporting member 70 are horizontally fixed in position relative to the main frame 55.

Forming the shaft-receiving members 72A and 72B with the same outer shape in this embodiment produces less manufacturing error than when the members are formed in different shapes, suppressing the amount that the rotational shafts of the photosensitive drums 31 tilt relative to a prescribed direction (specifically, a direction orthogonal to the conveying direction of the paper 4). Moreover, forming the shaft-receiving members 72A and 72B in planar shapes eliminates the need to perform a bending step and the like in the manufacturing process, further reducing manufacturing error between the shaft-receiving members 72A and 72B.

In addition, forming the shaft-receiving members 72A and 72B of a metal material can effectively suppress positional deviation in the shafts of the rotating members compared to when the members are formed of a synthetic resin material, for example. Forming the shaft-receiving members 72A and 72B by punching a metal material with the same die can prevent manufacturing error between the shaft-receiving members 72A and 72B, reliably suppressing the amount that the drum shafts 31A of the photosensitive drums 31 tilt relative to the prescribed direction.

The shaft-receiving members 72A and 72B are positioned in the main frame 55 by directly contacting with the insertion grooves 58 and the positioning member 60 of the main frame 55. Hence, the shaft-receiving members 72A and 72B can be positioned relative to the main frame 55 with greater precision than when positioning the shaft-receiving members 72A and 72B indirectly in the main frame 55 via the accommodating member 74, for example.

In this embodiment, the shaft-receiving members 72A and 72B are accommodated in the accommodating member 74 and the handle 84 is provided on the accommodating member 74 to facilitate mounting and removal of the shaft-receiving members 72A and 72B into and from the main casing 2. If the shaft-receiving members 72A and 72B are not allowed to move relative to the accommodating member 74, this would cause a possibility that the axes of the is photosensitive drums 31 could be moved out of position due to the effects of distortion in the accommodating member 74, which is formed of synthetic resin. Therefore, the shaft-receiving members 72A and 72B are allowed to move relative to the accommodating member 74 in this embodiment, suppressing deviation in the axes of the photosensitive drums 31 caused by such distortion or deformation of the accommodating member 74.

In this embodiment, the shaft-receiving grooves 90 of the shaft-receiving members 72A and 72B are open on the top, enabling the photosensitive drums 31 to be easily removed from the drum-supporting member 70 simply by removing the developer cartridges 34 from the drum-supporting member 70. Further, the shaft-receiving grooves 90 are formed in a V-shape that narrows from the open part 90A toward the closed part 90B for suppressing positional deviation of the photosensitive drums 31.

In this way, the drum-supporting member 70 suppresses tilting in the rotational shafts of the photosensitive drums 31, while enabling the photosensitive drums to be freely inserted into and removed from the drum-supporting member 70 of the printer 1.

While the invention has been described in detail with reference to specific embodiments thereof, it would be apparent to those skilled in the art that many modifications and variations may be made therein without departing from the spirit of the invention, the scope of which is defined by the attached claims.

Other than a member for supporting the photosensitive drums 31 as described above, the "shaft-receiving members 72A and 72B may be a support member for supporting rotational shafts of a transfer belt or paper-conveying belt.

In this embodiment, when the drum-supporting member 70 is pulled out from the main casing 2, the drum-supporting member 70 may configured to be completely detached from the main casing 2. Alternatively, the drum-supporting member 70 may configured to partially stay in the main casing 2.

In addition to a printing device such as a laser printer, the "image-forming device" may be a facsimile device or a multifunction device provided with a printer function and a scanner function. Further, the printing device is not limited to a tandem-type (single pass) printer having an image-carrying member for each developing unit, but may be a four-cycle (single drum) printer in which each developing unit develops a shared image-carrying member. The printing device may be either a direct transfer type for directly transferring a developer image onto a recording medium, or an intermediate transfer type for indirectly transferring the developer image onto an intermediate transfer belt. The printing device may also be an electrophotographic LED printer, as well as an inkjet printer.

What is claimed is:

1. A support member that is loadable into and unloadable from a main casing of an image-forming device, the support member supporting a rotary member having an axis, the support member comprising:

a pair of side plates facing each other, one of the pair of side plates being configured to support one side of the rotary member, and another of the pair of the side plates being configured to support an other side of the rotary member so that the rotary member is rotatable about the axis, each of the pair of side plates having the same outer shape and comprising:

a main portion;

a front end portion oriented upward from one end of the main portion, the front end portion having a through hole;

a rear end portion oriented upward from another end of the main portion, and a positioning portion for directly contacting a predetermined portion in the main casing of the image-forming device;

a coupling member comprising two end portions, each of the two end portions being configured to pass through a corresponding one of the through holes of the pair of side plates; and an accommodating member for accommodating the side plates in a manner in which the side plates are movable in the accommodating member, the accommodating member comprising a pair of side wall portions configured to accommodate the pair of side plates therebetween, wherein:

an insertion hole is formed in a front end portion of each of the pair of side wall portions, the pair of side plates are accommodated in the pair of side wall portions by inserting each of the two end portions of the coupling member through a corresponding one of the insertion holes of the pair of side wall portions, and the insertion hole in each side wall portion has a clearance relative to the two end portions of the coupling member such that the pair of side wall portions can separately move relative to the pair of side plates.

2. A photo sensitive drum support member for supporting a plurality of photosensitive drums for an image-forming device, each of the plurality of photosensitive drums having an axis, the photo sensitive drum support member comprising:

a pair of side plates facing each other, the pair of side plates being configured to rotatably support the axis of the plurality of photosensitive drums between the pair of the side plates, each of the pair of side plates having the same outer shape and comprising:

a main portion;

a front end portion oriented upward from one end of the main portion, the front end portion having a through hole;

a rear end portion oriented upward from another end of the main portion; and a positioning portion for directly contacting a predetermined portion in a main casing of the image-forming device;

a coupling member comprising two end portions, wherein each of the two end portions are configured to pass through a corresponding one of the through holes of the pair of side plates to span the pair of side plates; and an accommodating member for accommodating the side plates in a manner in which the side plates are movable in the accommodating member, the accommodating member comprising a pair of side wall portions configured to accommodate the pair of side plates therebetween, wherein:

an insertion hole is formed in a front end portion of each of the pair of side wall portions, the pair of side plates are accommodated in the pair of side wall portions by inserting each of the two end portions of the coupling member through a corresponding one of the insertion holes of the pair of side wall portions, and the insertion hole in each side wall portion has a clearance relative to the two end portions of the coupling member such that the pair of side wall portions can separately move relative to the pair of side plates.

3. A photo sensitive drum support member for supporting a plurality of photosensitive drums for an image-forming device, each of the plurality of photosensitive drums having an axis, the photo sensitive drum support member comprising:

a pair of side plates facing each other, the pair of side plates being configured to rotatably support the axis of the plurality of photosensitive drums between the pair of the side plates, each of the pair of side plates having the same outer shape and comprising:

a main portion;

a front end portion oriented upward from one end of the main portion, the front end portion having a through hole;

a rear end portion oriented upward from another end of the main portion; and a positioning portion for directly contacting a predetermined portion in a main casing of the image-forming device; and a coupling member comprising two end portions, wherein each of the two end portions are configured to pass through a corresponding one of the through holes of the pair of side plates to span the pair of side plates, wherein each of the plurality of photosensitive drums having an axis, each of the side plates includes a plurality of shaft supporting portions, each of the plurality of shaft supporting portions having an open upper end for supporting the axis of one of the plurality of photosensitive drums, a number of the plurality of shaft supporting portions of each of the side plates being the same as a number of the plurality of photosensitive drums.

4. The photo sensitive drum support member according to claim 3, wherein the axis of each of the plurality of photosensitive drums is a shaft, each of the plurality of shaft supporting portions has a V-shape having the open upper end and a closed bottom end, a lateral length of each of the plurality of shaft supporting portions becomes shorter from the open upper end to the closed bottom end.

5. A support member that is loadable into and unloadable from a main casing of an image-forming device, the support member supporting a rotary member having an axis, the support member comprising:

a pair of side plates facing each other, one of the pair of side plates being configured to support one side of the rotary member, and another of the pair of the side plates being configured to support an other side of the rotary member so that the rotary member is rotatable about the axis, each of the pair of side plates having the same outer shape and comprising:

a main portion;

a front end portion oriented upward from one end of the main portion, the front end portion having a through hole;

a rear end portion oriented upward from another end of the main portion, and a positioning portion for directly contacting a predetermined portion in the main casing of the image-forming device;

a coupling member comprising two end portions, each of the two end portions being configured to pass through a corresponding one of the through holes of the pair of side plates;

a pair of side wall portions configured to accommodate the pair of side plates therebetween;

a front wall portion coupling one end of each of the pair of side wall portions; and a rear wall portion coupling another end of each of the pair of side wall portions, wherein the coupling member is configured to pass through the through hole and protrude outside the side wall portion.

6. A photo sensitive drum support member for supporting a plurality of photosensitive drums for an image-forming device, each of the plurality of photosensitive drums having an axis, the photo sensitive drum support member comprising:

a pair of side plates facing each other, the pair of side plates being configured to rotatably support the axis of the plurality of photosensitive drums between the pair of the side plates, each of the pair of side plates having the same outer shape and comprising:

a main portion;

a front end portion oriented upward from one end of the main portion, the front end portion having a through hole;

a rear end portion oriented upward from another end of the main portion; and a positioning portion for directly contacting a predetermined portion in a main casing of the image-forming device;

a coupling member comprising two end portions, wherein each of the two end portions are configured to pass through a corresponding one of the through holes of the pair of side plates to span the pair of side plates, a pair of side wall portions configured to accommodate the pair of side plates therebetween;

a front wall portion coupling one end of each of the pair of side wall portions; and a rear wall portion coupling another end of each of the pair of side wall portions, wherein the coupling member is configured to pass through the through hole and protrude outside the side wall portion.

* * * * *